US007241067B2

(12) United States Patent
Cheng

(10) Patent No.: US 7,241,067 B2
(45) Date of Patent: Jul. 10, 2007

(54) RING MECHANISM HAVING BLUNT ENDS

(75) Inventor: Hung Yu Cheng, Hong Kong (CN)

(73) Assignee: World Wide Stationery Manufacturing Company, Limited, Kwai Chung, New Territory (HK)

( * ) Notice: Subject to any disclaimer, the term of this patent is extended or adjusted under 35 U.S.C. 154(b) by 455 days.

(21) Appl. No.: 10/681,512

(22) Filed: Oct. 8, 2003

(65) Prior Publication Data

US 2005/0079005 A1 Apr. 14, 2005

(51) Int. Cl.
*B42F 3/04* (2006.01)
*B42F 13/20* (2006.01)

(52) U.S. Cl. ..... 402/38; 402/20; 402/26; 402/31; 402/70

(58) Field of Classification Search ..... 402/19, 402/20, 26, 31, 32, 38, 70
See application file for complete search history.

(56) References Cited

U.S. PATENT DOCUMENTS

| | | | | | |
|---|---|---|---|---|---|
| 1,896,838 | A | * | 2/1933 | Dawson | 402/38 |
| 1,896,840 | A | * | 2/1933 | Dawson | 402/38 |
| 1,982,409 | A | * | 11/1934 | Adams | 402/32 |
| 2,013,552 | A | * | 9/1935 | Dawson | 402/38 |
| 2,041,168 | A | * | 5/1936 | Dawson | 402/38 |
| 3,884,586 | A | | 5/1975 | Michaelis et al. | |
| 4,522,526 | A | | 6/1985 | Lozfau et al. | |
| 4,813,803 | A | | 3/1989 | Gross | |
| 5,067,840 | A | * | 11/1991 | Cooper et al. | 402/38 |
| D397,146 | S | | 8/1998 | Chan | |
| 5,842,807 | A | | 12/1998 | To | |
| D408,851 | S | | 4/1999 | To | |
| 5,895,164 | A | * | 4/1999 | Wu | 402/36 |
| 5,971,649 | A | | 10/1999 | To | |
| 6,045,286 | A | | 4/2000 | Tung | |
| D426,571 | S | | 6/2000 | To | |
| D433,445 | S | | 11/2000 | To | |
| D434,071 | S | | 11/2000 | To | |
| 6,146,042 | A | | 11/2000 | To et al. | |
| 6,217,247 | B1 | | 4/2001 | Ng | |
| D457,559 | S | | 5/2002 | To | |
| D459,392 | S | | 6/2002 | Xu | |
| D473,897 | S | | 4/2003 | To | |
| 6,758,621 | B2 | | 7/2004 | To | |
| D513,765 | S | * | 1/2006 | Cheng | D19/32 |
| 2003/0026643 | A1 | | 2/2003 | To | |
| 2003/0053849 | A1 | | 3/2003 | To et al. | |

FOREIGN PATENT DOCUMENTS

| | | |
|---|---|---|
| CA | DES 98524 | 2/2003 |

* cited by examiner

*Primary Examiner*—Monica Carter
*Assistant Examiner*—Eric A. Gates
(74) *Attorney, Agent, or Firm*—Senniger Powers

(57) ABSTRACT

A ring mechanism for a loose-leaf binder comprises a thin, elongate plate and at least two ring members supported by the elongate plate. The ring members move between an open position for receiving and removing loose-leaf pages and a closed position for capturing the loose-leaf pages on the ring while permitting movement of the pages along the ring. The elongate plate has a longitudinal end including spaced apart first and second end portions located on one transverse side of the elongate plate. The first and second end portions are bent over to present a longitudinally facing surface which is blunt. A method of manufacturing a ring mechanism for a loose-leaf binder is also disclosed.

12 Claims, 19 Drawing Sheets

RING MECHANISM HAVING BLUNT ENDS

BACKGROUND OF THE INVENTION

This invention relates to binders for capturing loose-leaf pages, and in particular to an improved ring mechanism for opening and closing binders.

A loose-leaf binder retains loose-leaf pages, such as hole-punched papers, in a file or notebook. It features a ring mechanism having ring members for retaining the papers which may be selectively opened to add or remove papers, or closed to retain papers while allowing them to be moved along the ring members. Levers are typically provided on both longitudinal ends of the loose-leaf binder for moving the ring members between open and closed positions.

One drawback to loose-leaf binders of the prior art is that the ring mechanisms typically include rough or sharp edges projecting axially from longitudinal ends of an elongate plate which mounts the other components of the ring mechanism. When the elongate plate is cut from sheet metal, upper and lower edges project outwardly from each longitudinal end of the elongate plate. Longitudinal end margins of the elongate plate, including these cut edges, are typically pressed into flatwise engagement with one another to capture movable levers mounted at the longitudinal ends of the ring mechanism. The exposed edges continue to project outwardly and can snag clothing, scratch nearby items and may feel abrasive against a user's skin when operating the ring members. Other designs have attempted to address these undesirable attributes. For example, one such design has an upper surface that extends axially beyond the lower edge. The projecting portion is folded down so that it captures the lever at the longitudinal end of the ring mechanism and presents a blunt surface in a longitudinal direction. The projecting portion essentially provides a barrier covering the edges of the lower surface of the elongate plate. This design also fails to avoid the ill-effects noted above because small items may still become caught under the edge of the folded down projecting portion, and because the manufacture of such a ring mechanism is more complex. It is thus desirable to construct a binder wherein the formation and orientation of such edges minimizes these ill-effects.

SUMMARY OF THE INVENTION

Generally, a ring mechanism for a loose-leaf binder comprises a thin, elongate plate, and at least two ring members supported by the elongate plate for relative movement of the ring members. The ring members are moveable between an open position, in which the ring members are spaced apart and loose-leaf pages may be received on and removed from at least one of the ring members, and a closed position, in which the ring members are engaged to form a ring which is configured to capture the loose-leaf pages on the ring while permitting movement of the pages along the ring. The elongate plate has longitudinal ends, and at least one of the longitudinal ends includes first and second end portions located on one transverse side of the elongate plate. The first and second end portions are bent over to present a longitudinally facing surface which is blunt.

Another embodiment discloses a ring mechanism for a loose-leaf binder comprising a thin, elongate plate and at least two ring members supported by an elongate plate with first and second end portions. The first and second end portions are bent over to present a longitudinally facing surface which is blunt and free of bends about a common fold line.

Yet another embodiment discloses a method of manufacturing a ring mechanism for a loose-leaf binder movable between an open position and a closed position, generally as set forth above. The method comprises forming the thin, elongate plate with first and second at least partially opposed end portions located on one transverse side of the elongate plate. The method also comprises bending over the first end portion and the second end portion to orientations generally perpendicular to a longitudinal axis of the elongate plate.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
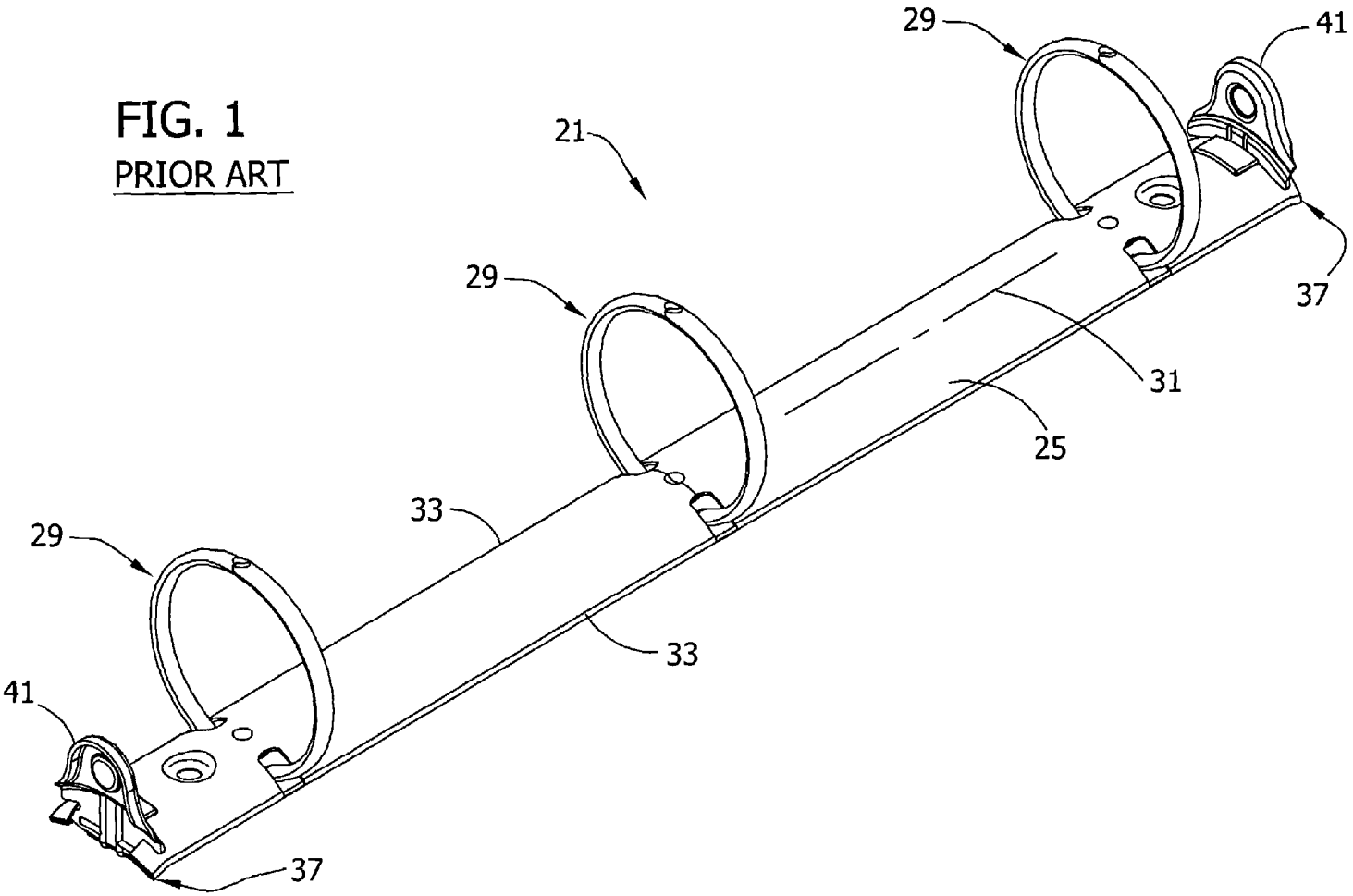
FIG. 1 PRIOR ART
FIG. 1 is a perspective of a conventional ring mechanism.
Figure 2:
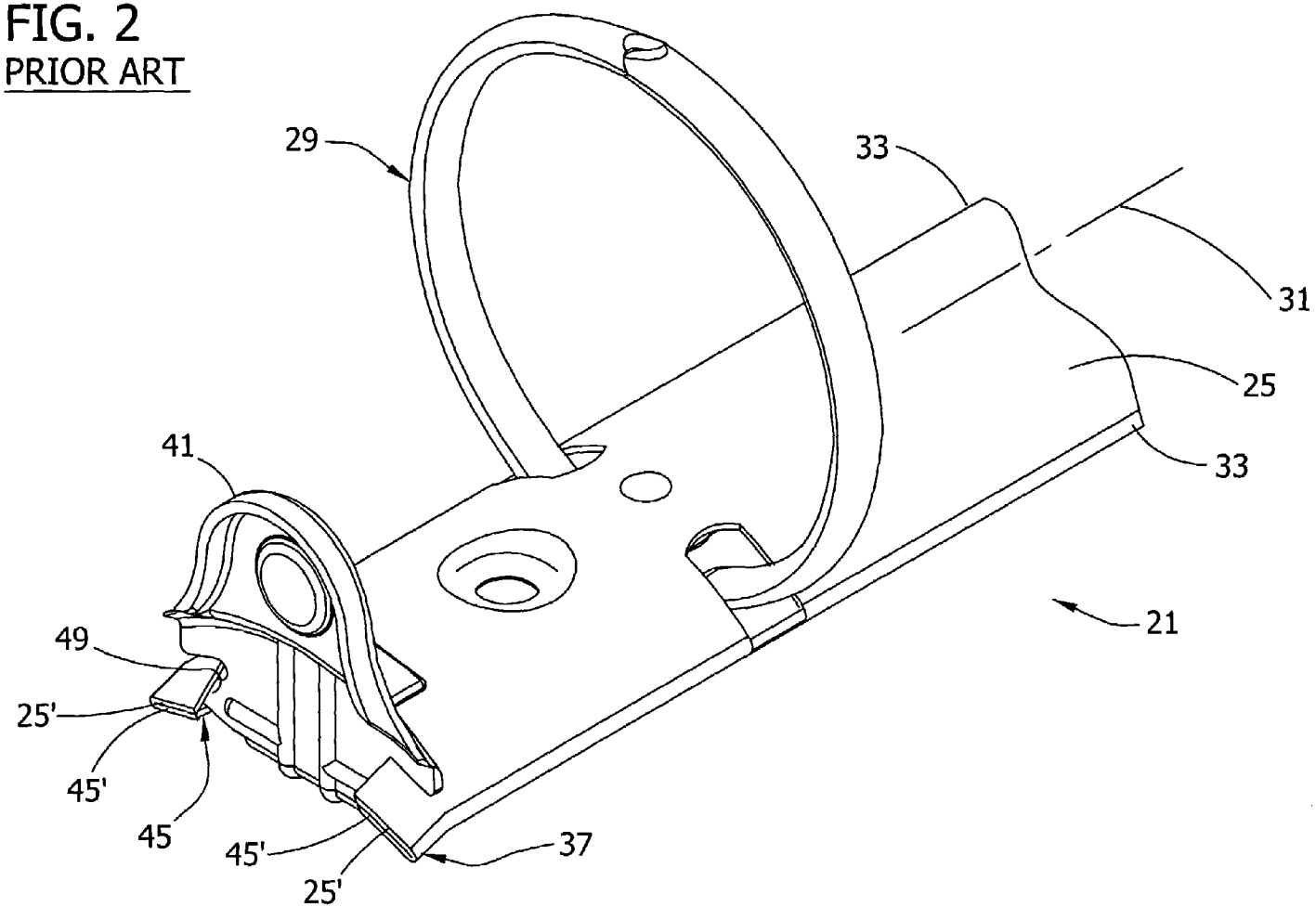
FIG. 2 PRIOR ART
FIG. 2 is an enlarged, fragmentary perspective of the conventional mechanism of FIG. 1.

Referring now to the drawings and in particular to FIGS. 1 and 2, a conventional loose-leaf binder mechanism for retaining loose-leaf pages is indicated generally at 21. The mechanism 21 includes an elongate plate 25 and three rings, each indicated generally at 29, for capturing loose-leaf pages. The elongate plate 25 is made of sheet metal shaped as an elongated rectangle with a generally arch-shaped elevated profile. The elongate plate 25 has a longitudinal axis 31, two generally opposite longitudinal edges 33, and two generally opposite longitudinal ends, generally indicated 37. Levers 41 pivotally mount on the elongate plate 25 generally at each longitudinal end 37 for controlling pivoting movement of the rings 29 between a closed position (FIG. 1) and an open position (not shown).

As is best depicted in FIG. 2, a bent under lip, generally indicated 45, is formed along the longitudinal edges 33 of the elongate plate 25. This lip 45 extends the length of the elongate plate 25, terminating at each longitudinal end 37. Portions of the elongate plate 25 and lip 45, indicated 25' and 45', respectively, extend beyond the levers 41. These portions 25', 45' are pressed flat against one another, thereby capturing the levers 41 for pivoting movement of the levers about tabs 49 extending laterally from the levers. Flattened portions 25',45' extend laterally from the longitudinal ends 37 of the mechanism 21, orienting the end portions, which are typically cut and may include rough edges, outward for potential contact with other items, such as clothing, a user's skin or any other material contacting the mechanism.

Figure 3:
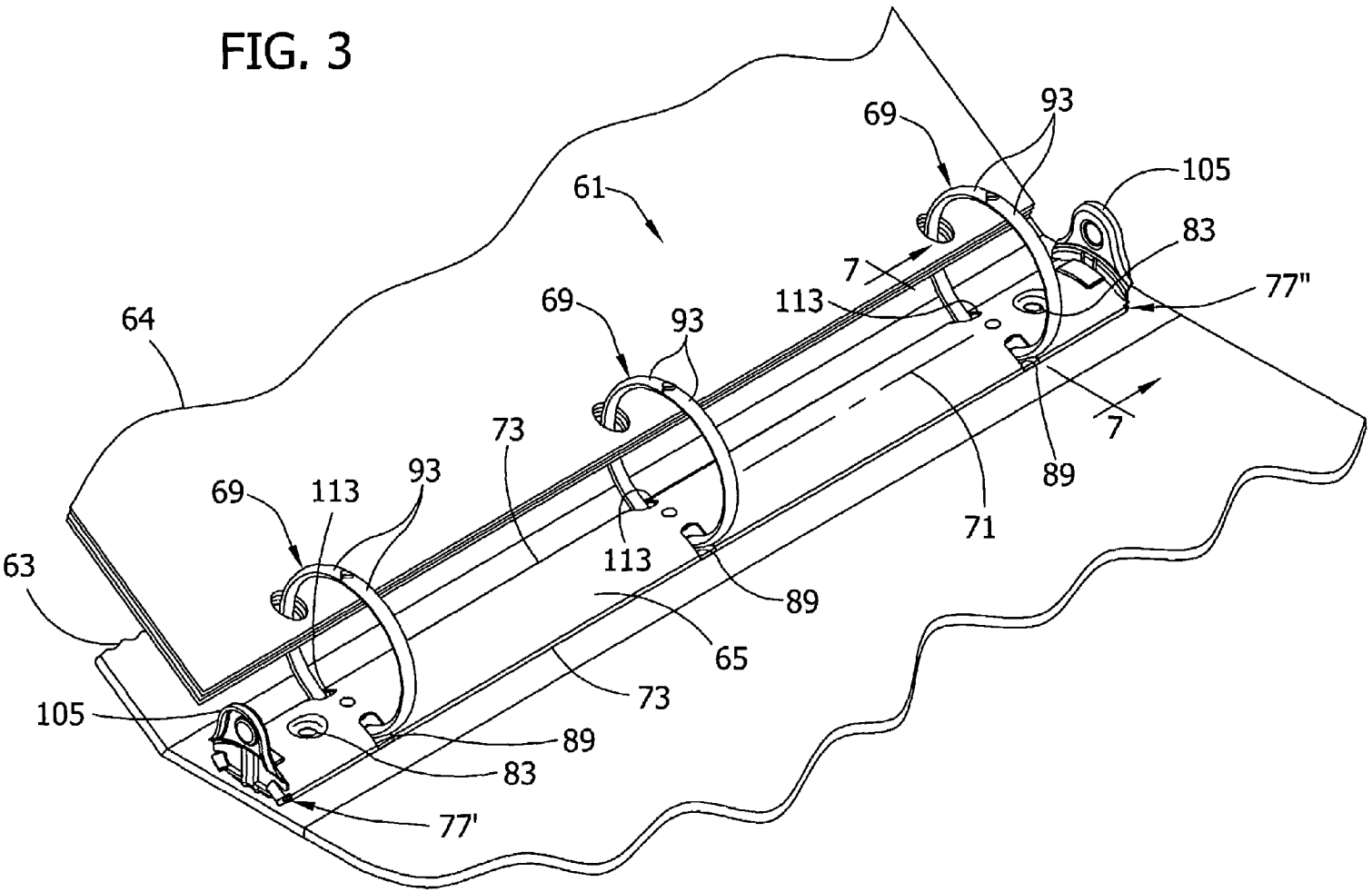
FIG. 3 is a perspective of a loose-leaf binder and ring mechanism of a first embodiment of the present invention in a closed position.
Figure 4:
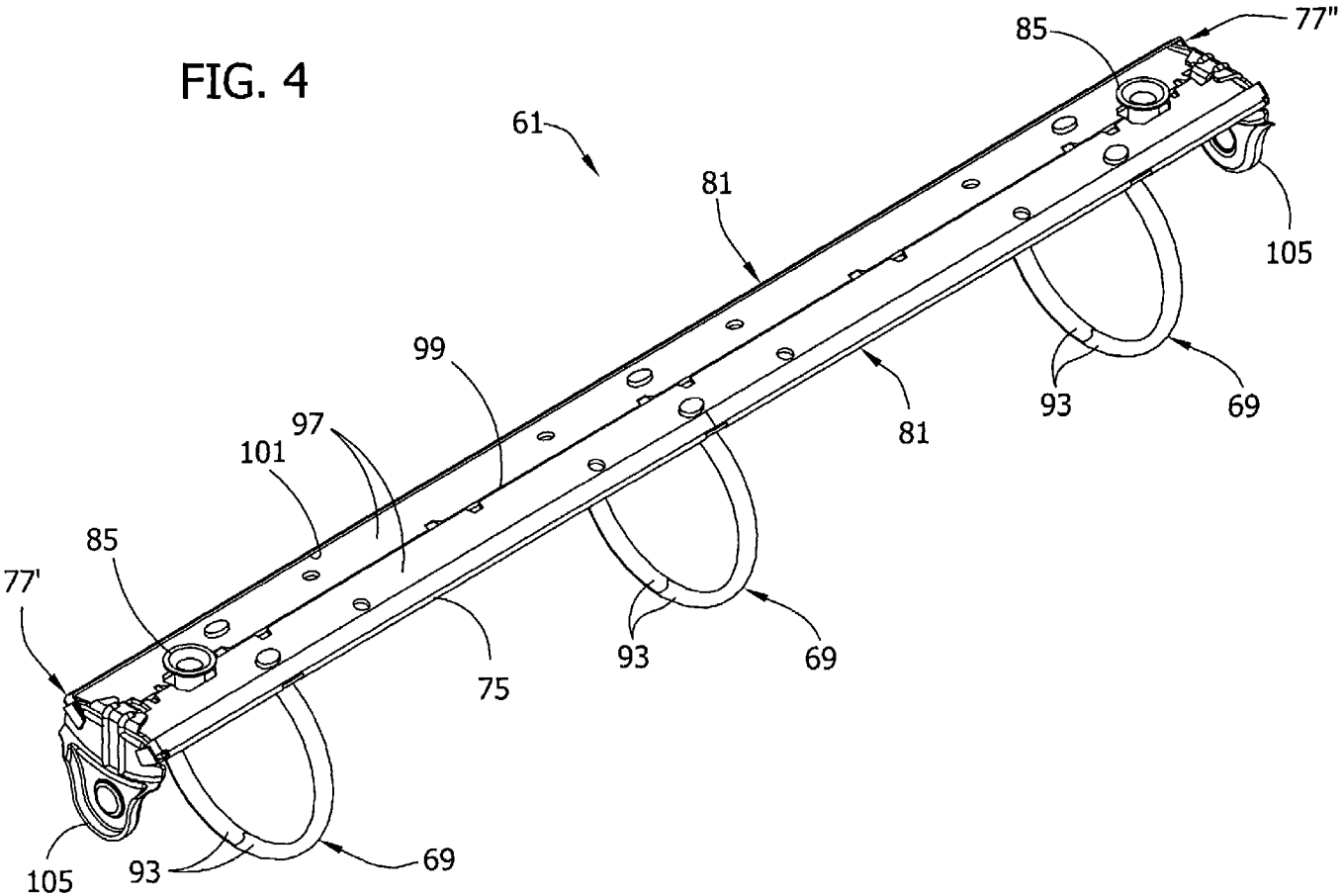
FIG. 4 is a bottom perspective of the mechanism of FIG. 3.
Figure 6:
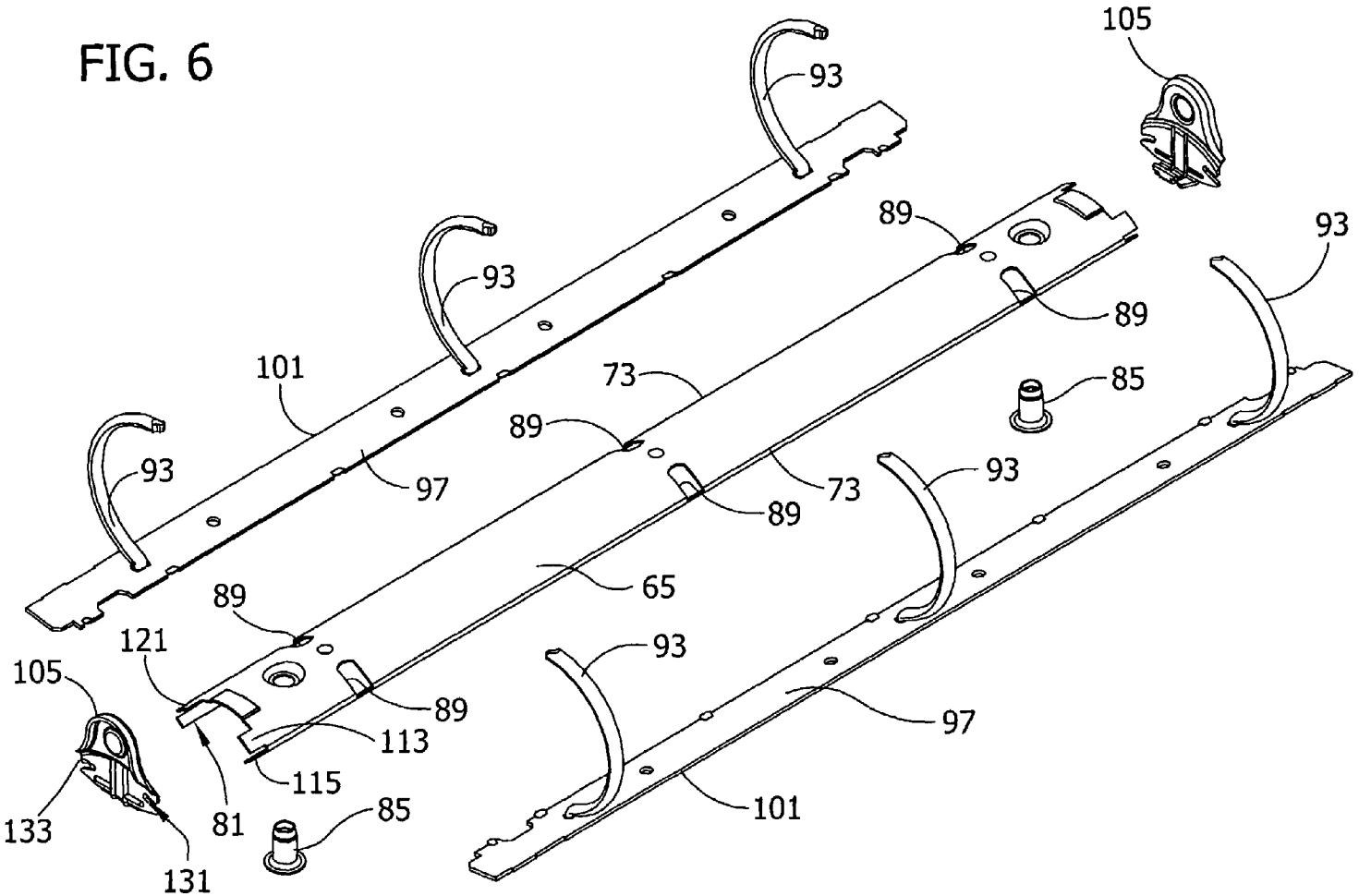
FIG. 6 is an exploded perspective of the mechanism of FIG. 3.
Figure 7:
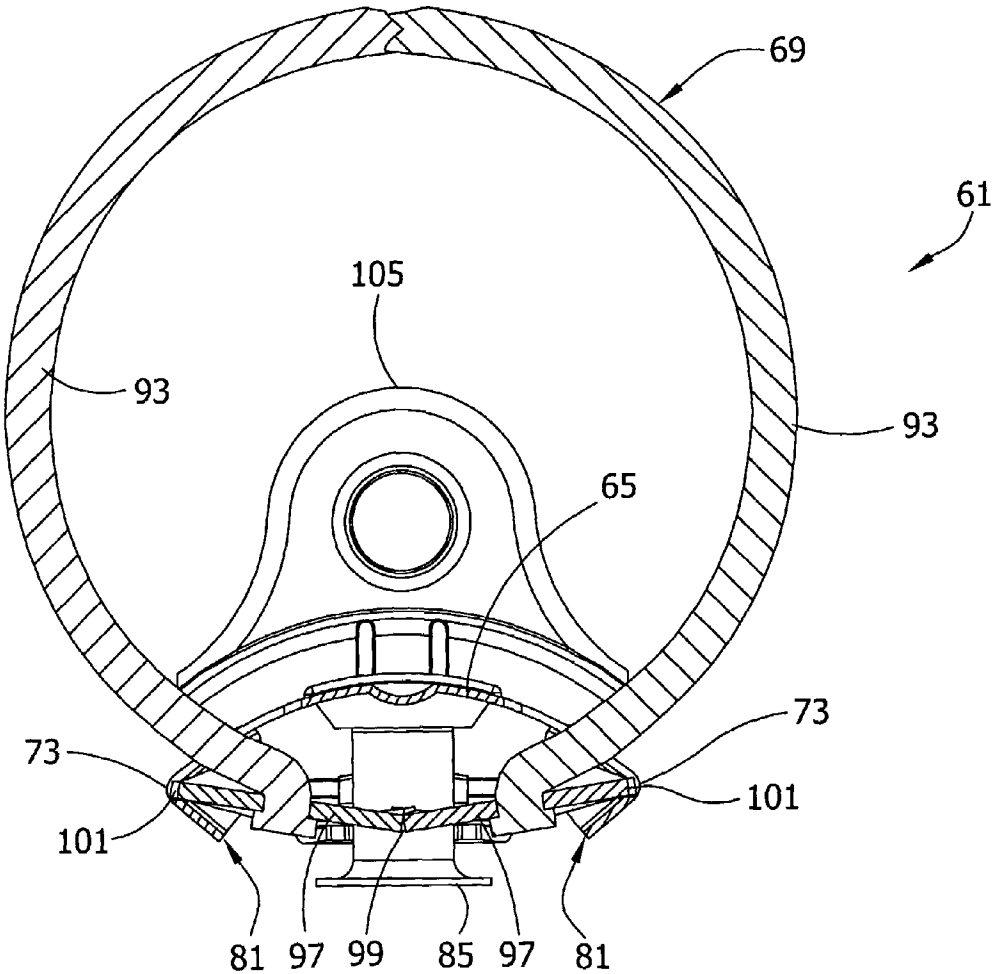
FIG. 7 is an enlarged section of the mechanism taken through line 7-7 of FIG. 3.

Referring now to FIGS. 3 and 4, a ring mechanism, generally indicated 61, for a loose-leaf binder 63 according to the present invention is shown for retaining loose-leaf pages 64. The ring mechanism 61 comprises a thin, elongate plate 65 and three rings, each indicated generally at 69, supported by the elongate plate for capturing loose-leaf pages 64. There is a commonly provided number of rings, but it will be understood there may be fewer or more than three rings without departing from the scope of the present invention. The elongate plate 65 is made of sheet metal shaped as an elongated rectangle with a uniform, generally arch-shaped elevated profile (e.g., FIG. 7). The elongate plate 65 has a longitudinal axis 71, two generally transversely opposite longitudinal edges 73, and first and second generally opposite longitudinal ends, generally indicated at 77' and 77". As is best depicted in FIGS. 4, 6 and 7, a bent under lip, generally indicated 81, is formed along the longitudinal edges 73 of the elongate plate 65. This lip 81 extends the full length of the elongate plate 65, terminating at each longitudinal end 77', 77".

The elongate plate 65 is constructed of metal or other suitable material which is sufficiently rigid to provide a stable mount for other components of the mechanism 61, while being lightweight. Two openings 83 (FIG. 3) are provided for receiving and attaching mounting posts 85 (FIGS. 4, 6 and 7) to secure the mechanism 61 to the loose-leaf binder 63. Six additional holes 89 are positioned along the longitudinal edges 73 to receive the rings 69 therethrough (FIGS. 3 and 6). Mechanisms having plates or housings of other shapes, including irregular shapes, or housings which are integral with a file or notebook, do not depart from the scope of this invention.

Figure 5:
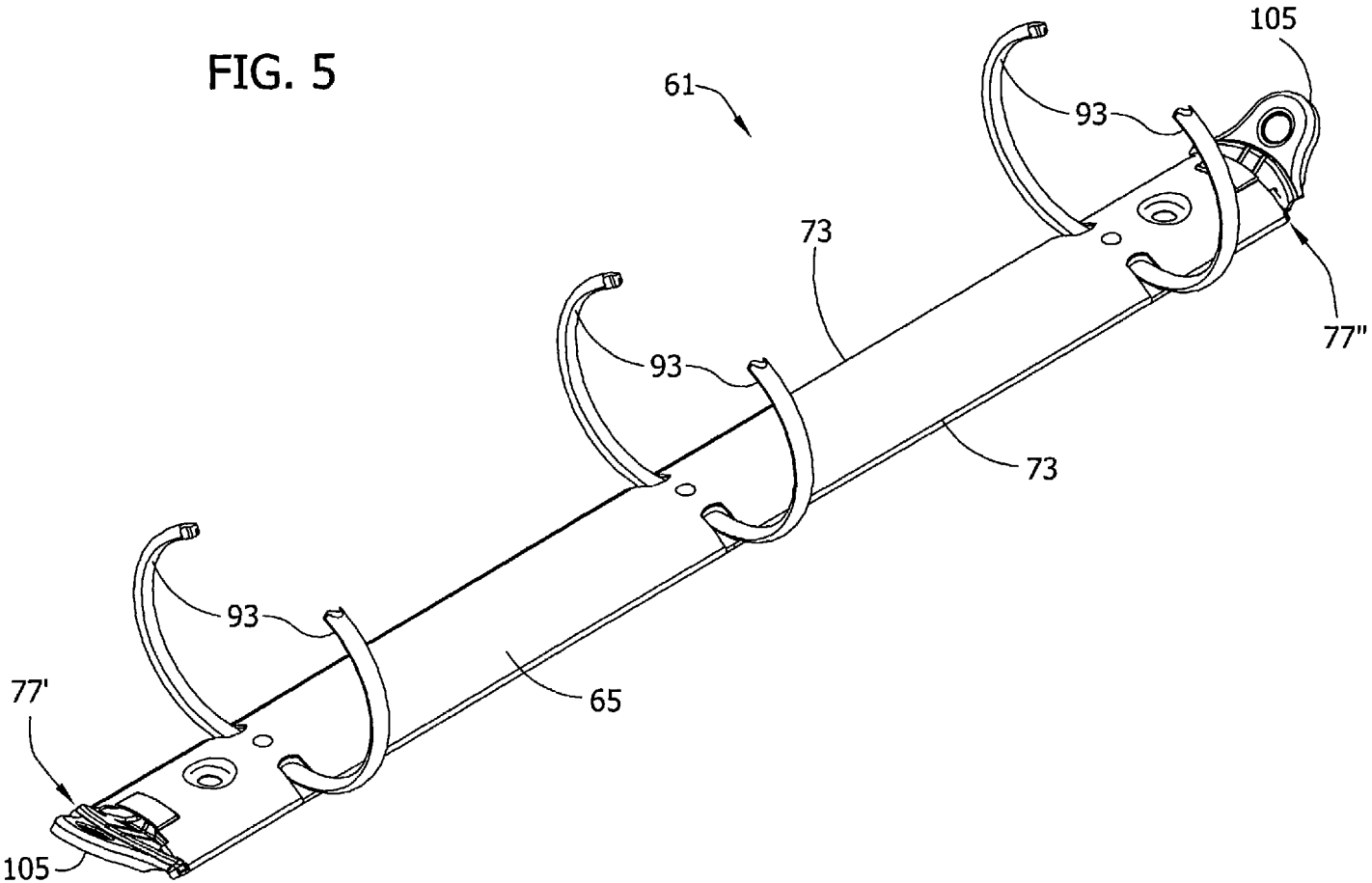
FIG. 5 is a perspective of the mechanism of FIG. 3 with the mechanism in an open position.

Each of the three rings 69 includes two ring members 93 which are movable relative one another between a closed position (FIGS. 3 and 4), wherein the ring members are engaged to form a continuous, closed-loop ring configured to capture the loose-leaf pages 64 on the ring while permitting movement of the pages along the ring, and an open position (FIG. 5) in which the ring members are spaced apart to form an open loop suitable for receiving or removing pages from the ring members. The ring members 93 are formed of a conventional, cylindrical rod of a suitable material, such as steel. Although both ring members 93 of each ring 69 are movable in the illustrated embodiment, a mechanism having a movable ring member and a fixed ring member does not depart from the scope of this invention. It is understood that a mechanism having rings of other shapes (e.g., slanted D) does not depart from the scope of this invention.

Each of the ring members 93 is mounted on one of a pair elongate leaves 97 (FIGS. 4, 6 and 7), which are carried by the elongate plate 65 for pivotal motion relative to the elongate plate to move the ring members between the closed and open positions. The elongate leaves 97 are mounted in parallel arrangement and attached to each other for pivotal motion along adjoining longitudinal edges to form a hinge 99. Each elongate leaf 97 has an outer longitudinal edge margin 101 opposite the hinge 99 that is received in the corresponding bent under lip 81 of the elongate plate 65. The longitudinal edge margins 101 are free to move within the lip 81 to allow pivoting movement of the elongate leaves 97 on the hinge 99. The elongate plate 65 provides an inwardly-directed spring force to bias the elongate leaves 97 to pivot away from a co-planar position (i.e., toward either the closed position or the open position).

A lever 105 pivotally mounts on the elongate plate 65 generally at the first longitudinal end 77' for actuating movement of the ring members 93 between the open and closed positions by controlling pivoting movement of the elongate leaves 97. Another lever 105 of similar construction pivotally mounts on the elongate plate 65 generally at the second longitudinal end 77" for actuating movement of the ring members 93 between the open and closed positions. The levers 105 and leaves 97 are operatively connected whereby the levers actuate pivoting movement of the leaves in a conventional manner. The rings 69 may also be opened simply by pulling adjacent ring members 93 apart or may be closed simply by pushing adjacent ring members together. Pulling or pushing the ring members 93 similarly actuates pivoting movement of the leaves 97.

Figure 8:
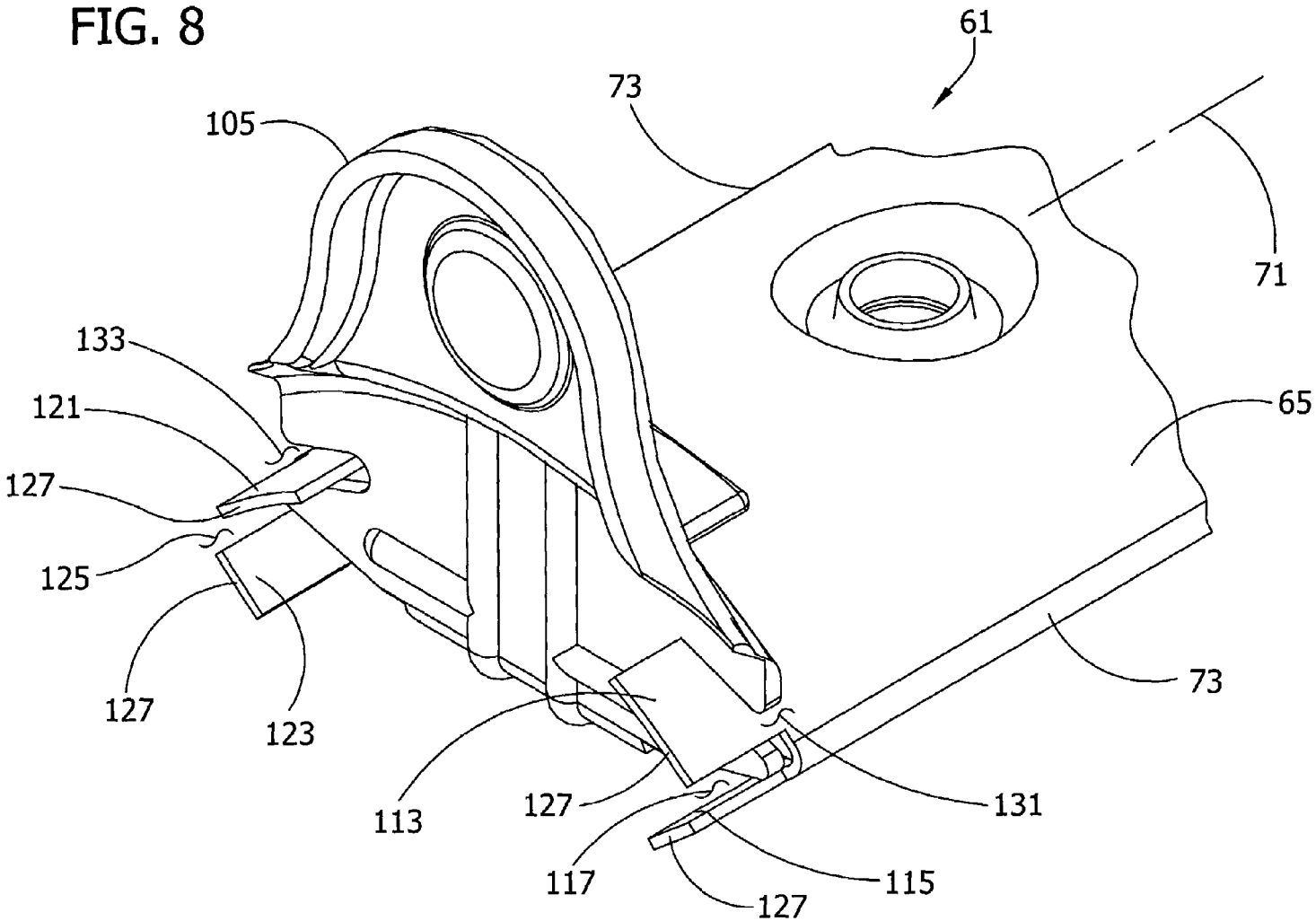
FIG. 8 is an enlarged, fragmentary perspective of the mechanism of FIG. 7 with end portions in an unbent condition.
Figure 9:
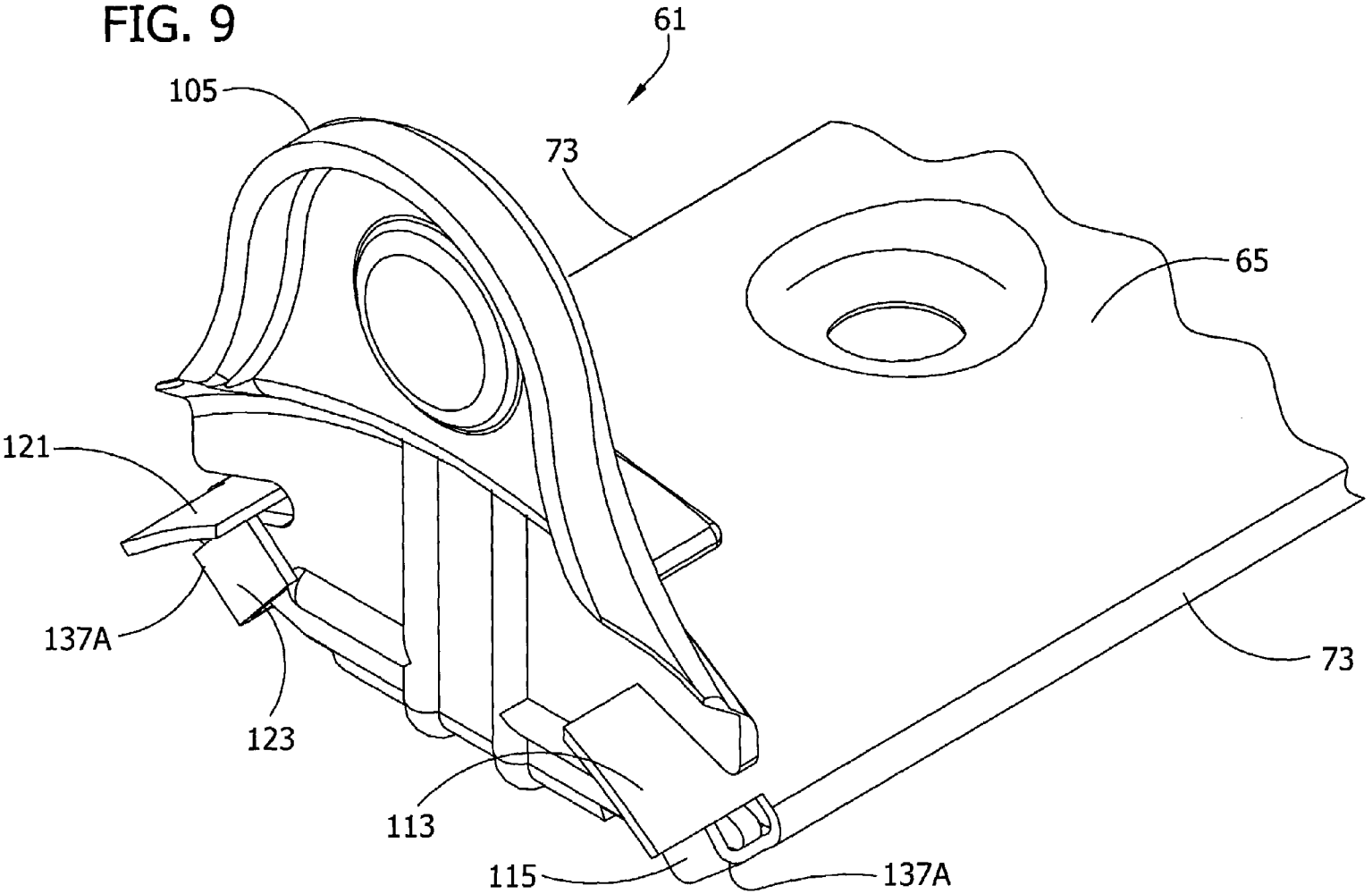
FIG. 9 is an enlarged, fragmentary perspective of the mechanism of FIG. 8 with one end portion on each transverse side in an unbent condition and the other end portion on each transverse side in a bent condition.
Figure 10:
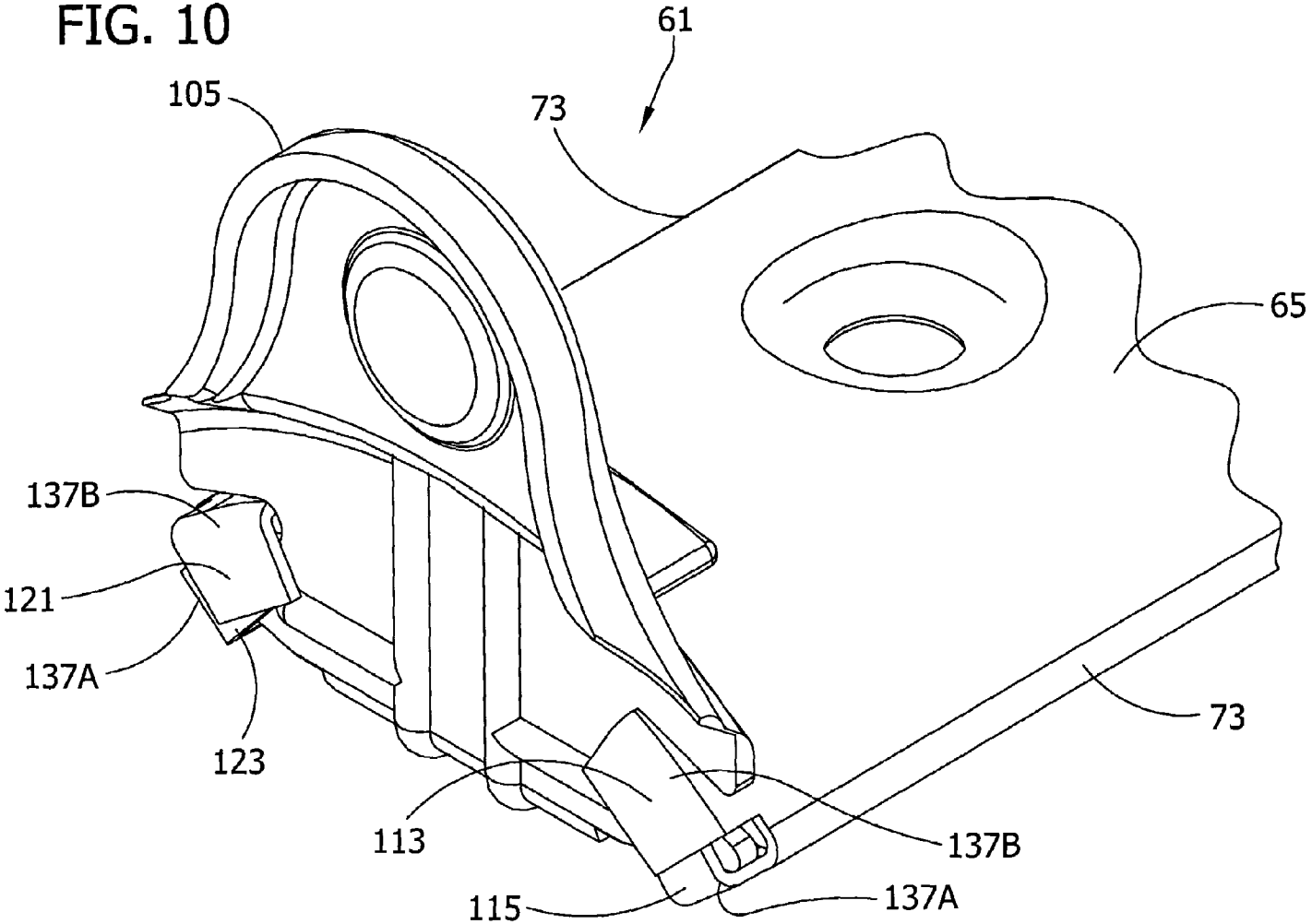
FIG. 10 is the perspective of FIG. 9 with all end portions in a bent condition.
Figure 10A:
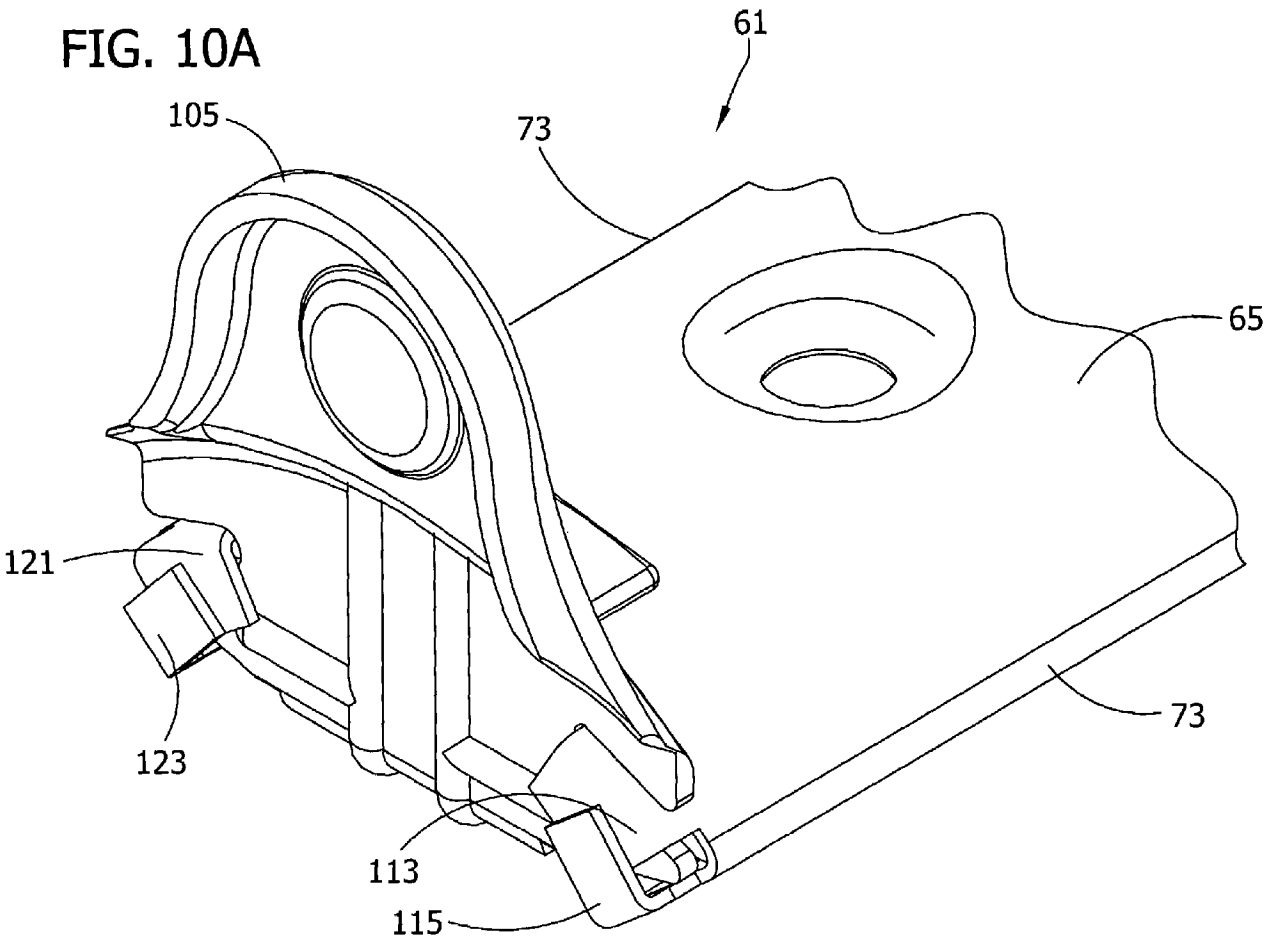
FIG. 10A is the perspective of FIG. 9A with all end portions in a bent condition.

Referring now to FIGS. 8 through 10A, the first longitudinal end 77' of the elongate plate 65 includes a first end portion 113 and a second end portion 115 located on one transverse side of the elongate plate (FIGS. 6 and 8). A space 117 (FIG. 8) cutout from the longitudinal end 77' separates the first and second end portions 113,115 into distinct tabs extending from the elongate plate 65, such that the first and second end portions may be individually bent over to present a blunt, longitudinally facing surface (FIGS. 10 and 10A). The mechanism 61 further comprises a third end portion 121 and a fourth end portion 123 on a transverse side of the elongate plate 65 opposite the transverse side of the first and second end portions 113,115 at the first longitudinal end 77'. A space 125 (FIG. 8) cutout from the first longitudinal end 77' separates the third and fourth end portions 121,123 into distinct tabs extending from the elongate plate 65, such that the third and fourth end portions may be individually bent over to present a blunt, longitudinally facing surface (FIGS. 10 and 10A). Each of the first, second, third and fourth end portions 113,115,121,123 is formed generally perpendicular to the longitudinal axis 71 of the elongate plate 65 (FIG. 8). The levers 105 each include slots, a first slot 131 receiving the first end portion 113 and a second slot 133 receiving the third end portion 121 (FIGS. 6 and 8), at respective longitudinal ends 77',77" of the elongate plate 65, for pivoting with respect to the elongate plate.

The second longitudinal end 77" of the mechanism is formed the same as the first longitudinal end 77'. In particular, the elongate plate 65 comprises first and second end portions at one transverse side of the elongate plate at the second longitudinal end 77". Accordingly, the foregoing description suffices for the end portions 113,115,121,123 at the second longitudinal end 77". However, it will be understood that the end portions at the second longitudinal end 77" could be formed differently from those at the first longitudinal end 77' without departing from the scope of the present invention.

As depicted in FIGS. 7 and 8, when initially formed, the first and third end portions 113,121 are continuations of the surface of the elongate plate 65 and present a thin, potentially sharp edge in the longitudinal direction. The second and fourth end portions 115,123 are continuations of the surface of the lip 81 and present a thin, potentially sharp edge in the longitudinal direction. First and second end portions 113,121 project longitudinally outward past the lever 105 and are spaced apart from one another by the cutout space 117 into distinct tabs extending from the elongate plate 65. Similarly, third and fourth end portions 121,123 project longitudinally outward past the lever 105 and are spaced apart from one another by the cutout space 125 into distinct tabs extending from the elongate plate 65. The end portions 113,115,121,123 are then individually bent over, thereby capturing the lever 105 and forming the blunt, longitudinally facing surfaces of FIGS. 10 and 10A. Each of the end portions 113,115,121,123 is bent about a distinct fold line associated with each end portion. In other words, the end portions 113,115,121,123 are free of bends about a common fold line. The second end portion 115 is bent upward about a lower fold line 137A, while the first end portion 113 is bent downward about an upper fold line 137B (FIG. 10). Similarly, the fourth end portion 123 is bent upward about a lower fold line 137A, while the third end portion 121 is bent downward about an upper fold line 137B. It is also contemplated that the end portions 113,115,121,123 may be bent with two or more bends.

Figure 9A:
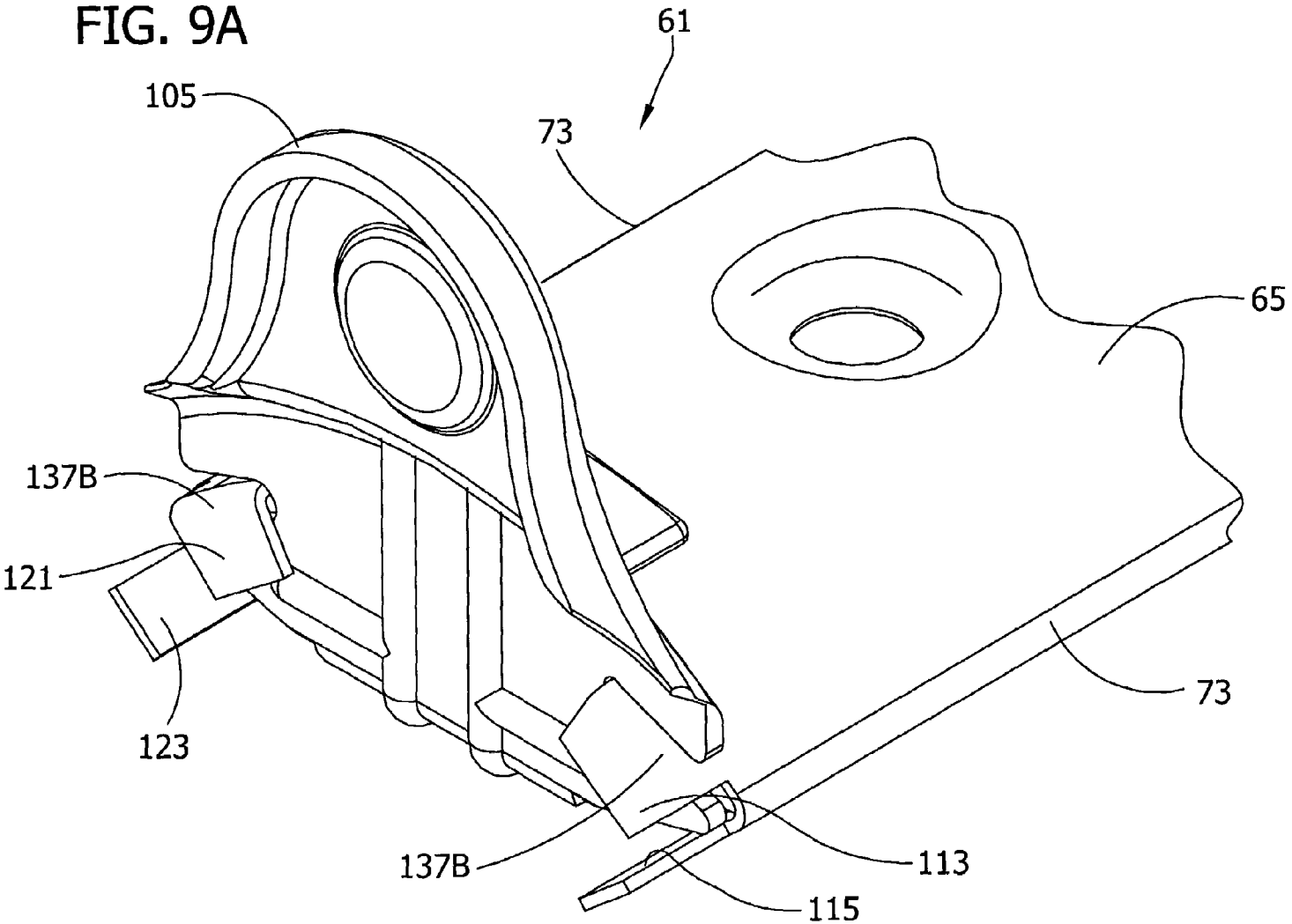
FIG. 9A is an enlarged, fragmentary perspective of a second embodiment of the mechanism of FIG. 9.

The invention is additionally directed to a method of manufacturing a ring mechanism 61 for a loose-leaf binder 63, generally as set forth above. The thin, elongate plate 65 is formed with first and second, at least partially opposed, end portions 113,115 located on one transverse side thereof and third and fourth, at least partially opposed, end portions 121,123 located on the opposite transverse side thereof. Second, FIGS. 9 and 9A depict the first bend in the forming process for two alternate embodiments. FIG. 9 depicts a first embodiment, wherein the second end portion 115 and the fourth end portion 123 are bent over along lower fold lines 137A before the first end portion 113 and the third end portion 121, respectively. FIG. 9A depicts a second embodiment wherein the first end portion 113 and the third end portion 121 are bent over along upper fold lines 137B before the second end portion 115 and the fourth end portion 123, respectively. FIGS. 10 and 10A depict the second bending in the method of manufacturing for the two embodiments. FIG. 10 depicts the first embodiment wherein the first end portion 113 and the third end portion 121 are bent over onto the second end portion 115 and the fourth end portion 123, respectively. FIG. 10A depicts a second embodiment wherein the second end portion 115 and the fourth end portion 123 are bent over onto the first end portion 113 and the third end portion 121, respectively. Both embodiments form blunt, longitudinally facing surfaces. Other embodiments are contemplated as within the scope of the present invention. For example, the first and second embodiments may be combined, such that the first end portion 113 is bent over first on one transverse side of the mechanism 61, while the fourth end portion 123 is bent over first on the other transverse side of the mechanism. In addition, methods of manufacturing a ring mechanism corresponding to third and fourth embodiments of the present invention, described in detail below, are also contemplated.

Figure 11:
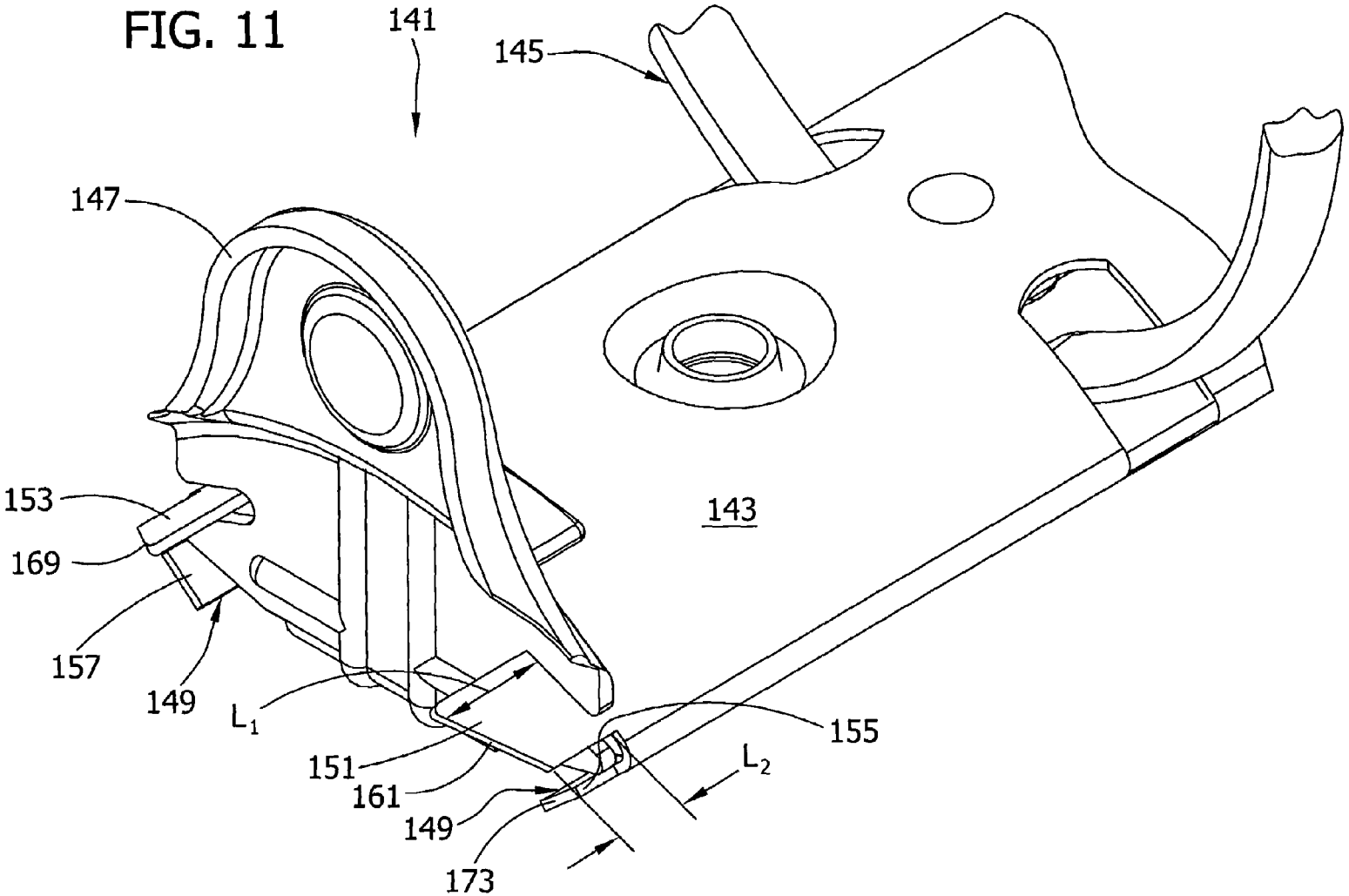
FIG. 11 is an enlarged, fragmentary perspective of a ring mechanism of a third embodiment with end portions in an unbent condition.
Figure 12:
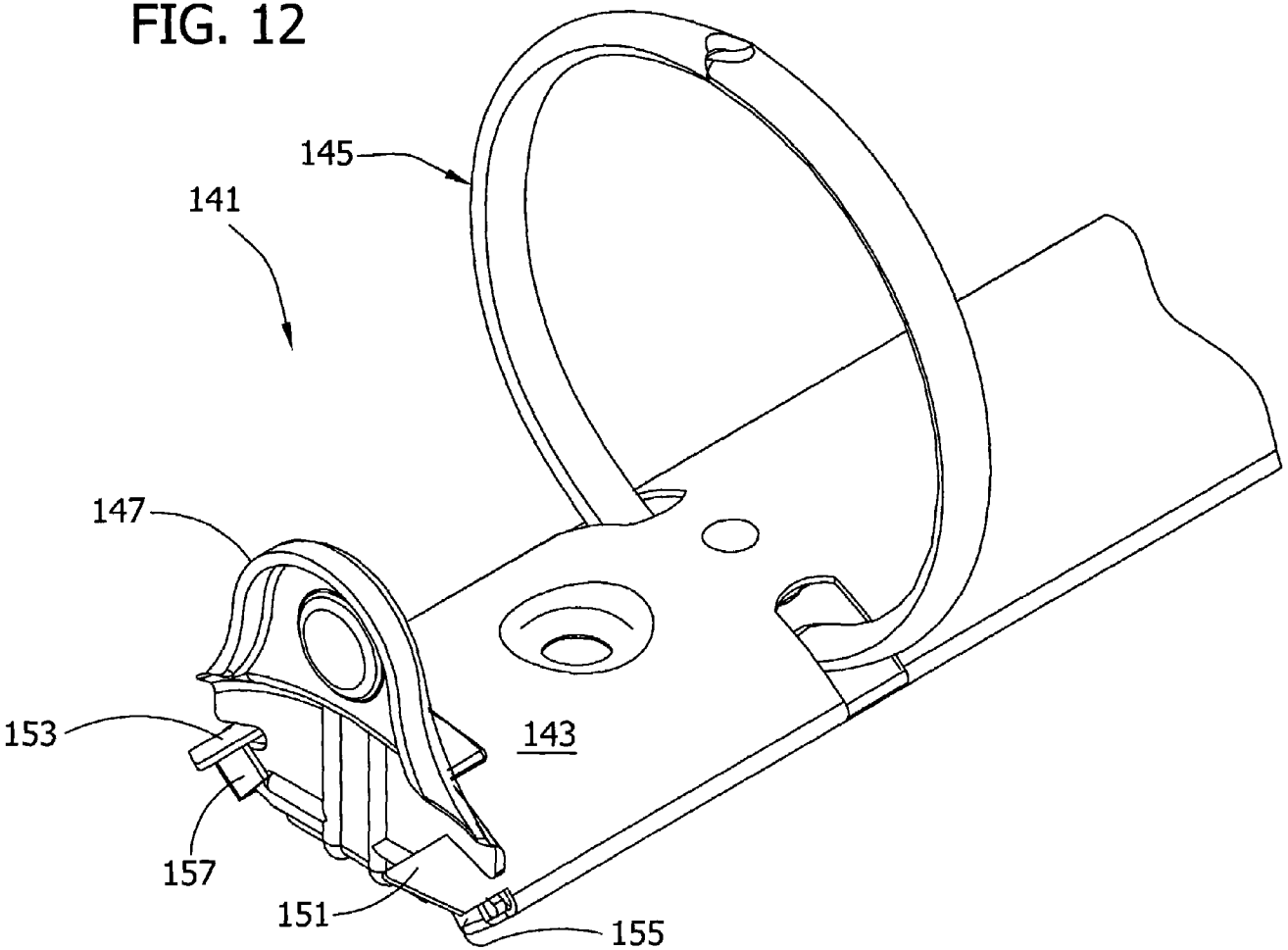
FIG. 12 is the perspective of FIG. 11 with one end portion on each transverse side in a bent condition and the other end portion on each transverse side in an unbent condition.
Figure 13:
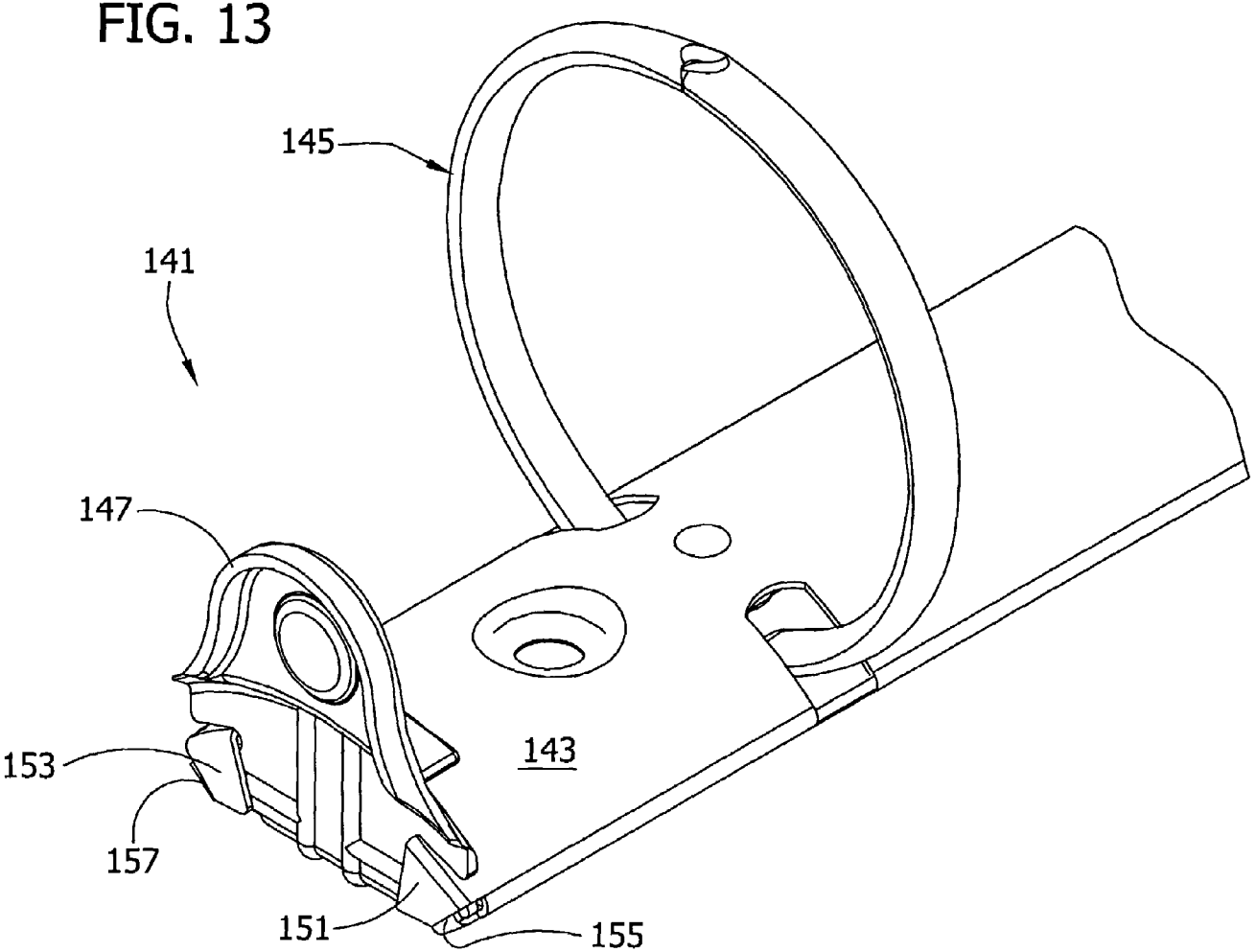
FIG. 13 is the perspective of the mechanism of FIG. 11 with all end portions in a bent condition.
Figure 14:
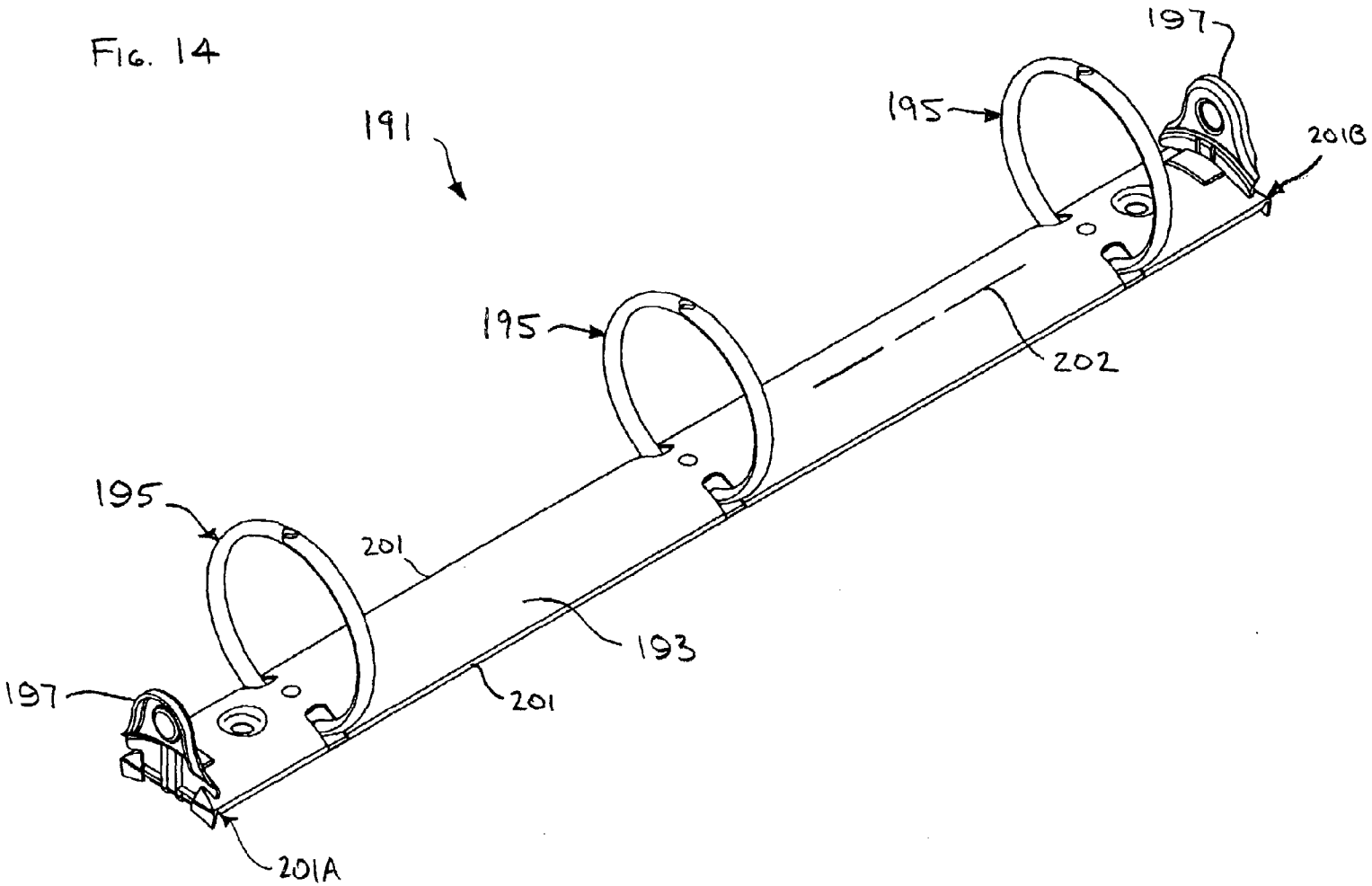
FIG. 14 is a perspective of a ring mechanism of a fourth embodiment of the present invention in a closed position.

In a third embodiment depicted in FIGS. 11-13, a ring mechanism for a loose-leaf binder is indicated generally at 141. The ring mechanism 141 comprises a thin, elongate plate 143, three rings indicated generally at 145, levers 147 and a bent under lip, generally indicated 149, generally as set forth above. In the third embodiment, a first end portion 151 and a third end portion 153 are longer than a second end portion 155 and a fourth end portion 157, respectively, at each longitudinal end of the elongate plate 143. In particular, a distal end 161 of the first end portion 151 tapers from a first length $L_1$ at an inner lateral edge of the first end portion to a second length $L_2$ at an outer lateral edge of the first end portion. As shown in detail in FIG. 11, the first length $L_1$ of the first end portion 151 is greater than the second length $L_2$ of the first end portion 151. Moreover, the distal end 161 of the first end portion 151 tapers between the first length $L_1$ and the second length $L_2$. When the first end portion 151 is bent over the second end portion 155 to form a substantially blunt end (FIG. 13), the taper of the distal end 161 is similar to the end shape of the bent under lip 149 to minimize its tendency to snag clothing or scratch nearby items. In other words, the distal end 161 of the bent over first end portion 151 extends downward only to the lowermost portion of the bent under lip 149, where it is protected from snagging clothing or scratching nearby items. The end portions 151, 155 are readily formed by cutting out a portion of the elongate plate 143 corresponding to the shape of the end portions, as noted above with previous embodiments.

The second end portion 155 includes a similar taper at its distal end 173. The taper of the distal end 173 of the bent over second end portion 155 is similar to the end shape of the elongate plate 143. Similar to the first end portion 151, the distal end 173 of the bent over second end portion 155 does not extend beyond the lowermost surface, or underside, of the elongate plate 143. Thus, when the second end portion 155 is bent over before the first end portion 151, the second end portion extends upward less than the height of the space between the portions, thereby tucking itself under the first end portion and thereby allowing the first end portion to freely bend downward over the second end portion. With the second end portion 155 shorter than the first end portion 151 and both end portions shaped similar to the profile of either the elongate plate or the bent under lip, the second end portion, which is folded over first, may be completely covered over by the first end portion, which is folded over second. Such a configuration allows the end portions 151, 155 to fold over neatly for flatwise, or nearly flatwise, engagement with one another. The third end portion 153 and the fourth end portion 157 are mirror images of the first end portion 151 and the second end portion 155, respectively. It should be noted that the end portions need not both be of different lengths and include tapered distal ends to achieve the advantages noted immediately above. It should also be noted that the second end portion 155 may be bent over after the first end portion 151 (not shown). In this configuration, the first end portion 151 extends downward less than the height of the space between the portions, thereby tucking itself behind the second end portion 155 and thereby allowing the second end portion to freely bend upward over the first end portion. In this configuration, the first end portion 151 may be shorter than the second end portion 155 and both end portions shaped similar to the profile of either the elongate plate or the bent under lip.

Figure 15:
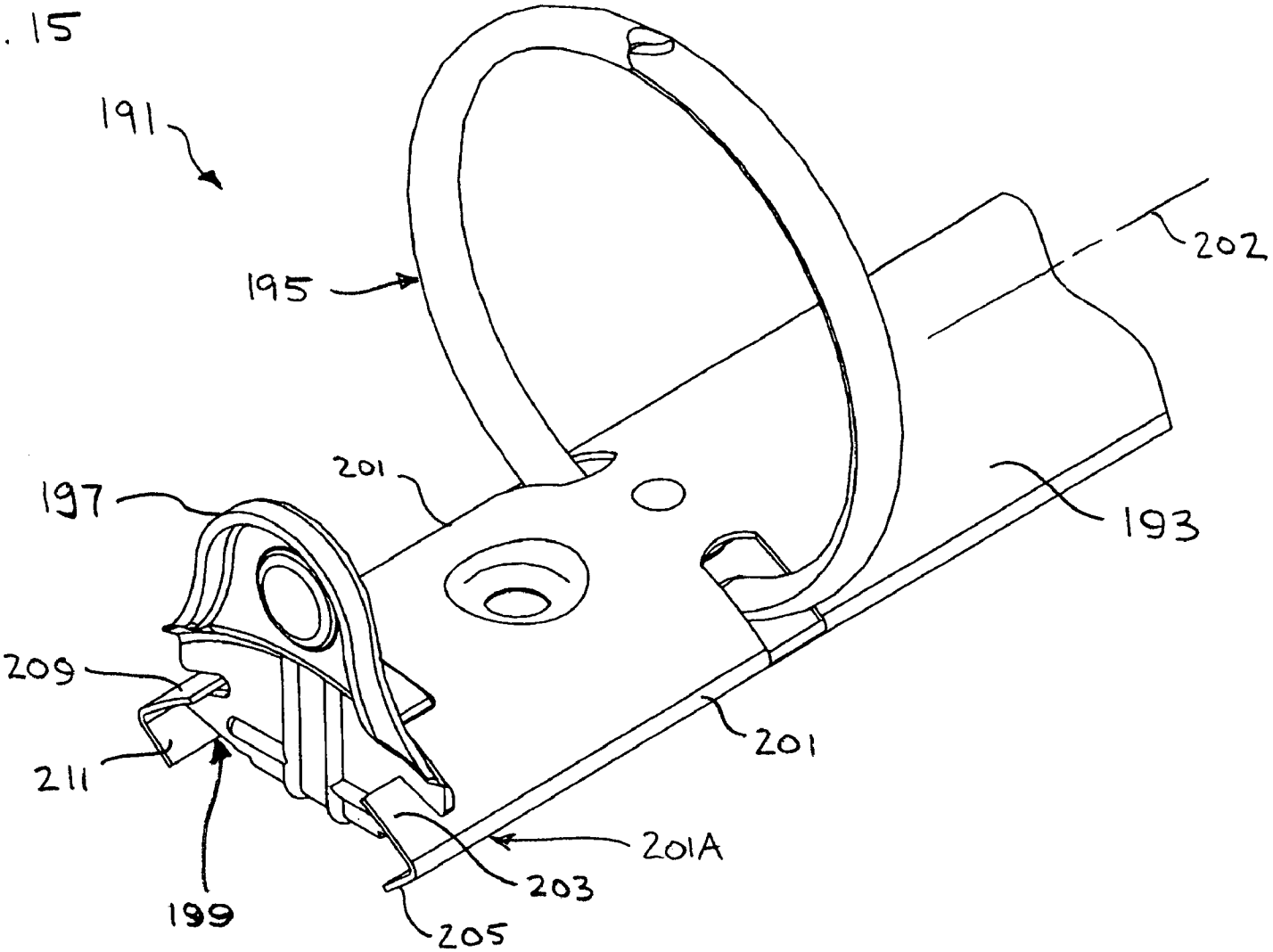
FIG. 15 is an enlarged, fragmentary perspective of the mechanism of FIG. 14 with end portions in an unbent condition.

In a fourth embodiment depicted in FIGS. 14-17, a ring mechanism for a loose-leaf binder is indicated generally at 191. The ring mechanism 191 comprises a thin, elongate plate 193, three rings indicated generally at 195, levers 197 and a bent under lip, generally indicated 199 (FIG. 15), generally as set forth above. The elongate plate 193 has two generally transversely opposite longitudinal edges 201 and a longitudinal axis 202, generally as set forth above. At one longitudinal end of the elongate plate 193, generally indicated 201A, a first end portion 203 and a second end portion 205 extend from one transverse side of the elongate plate (FIG. 15). End portions 203,205 extend beyond the lever 197 in generally the same shape as the elongate plate 193 and the bent under lip 199, respectively. A third end portion 209 and a fourth end portion 211 extend from the other transverse side of the elongate plate beyond the lever 197 in generally the same shape as the elongate plate 193 and the bent under lip 199, respectively.

Figure 16:
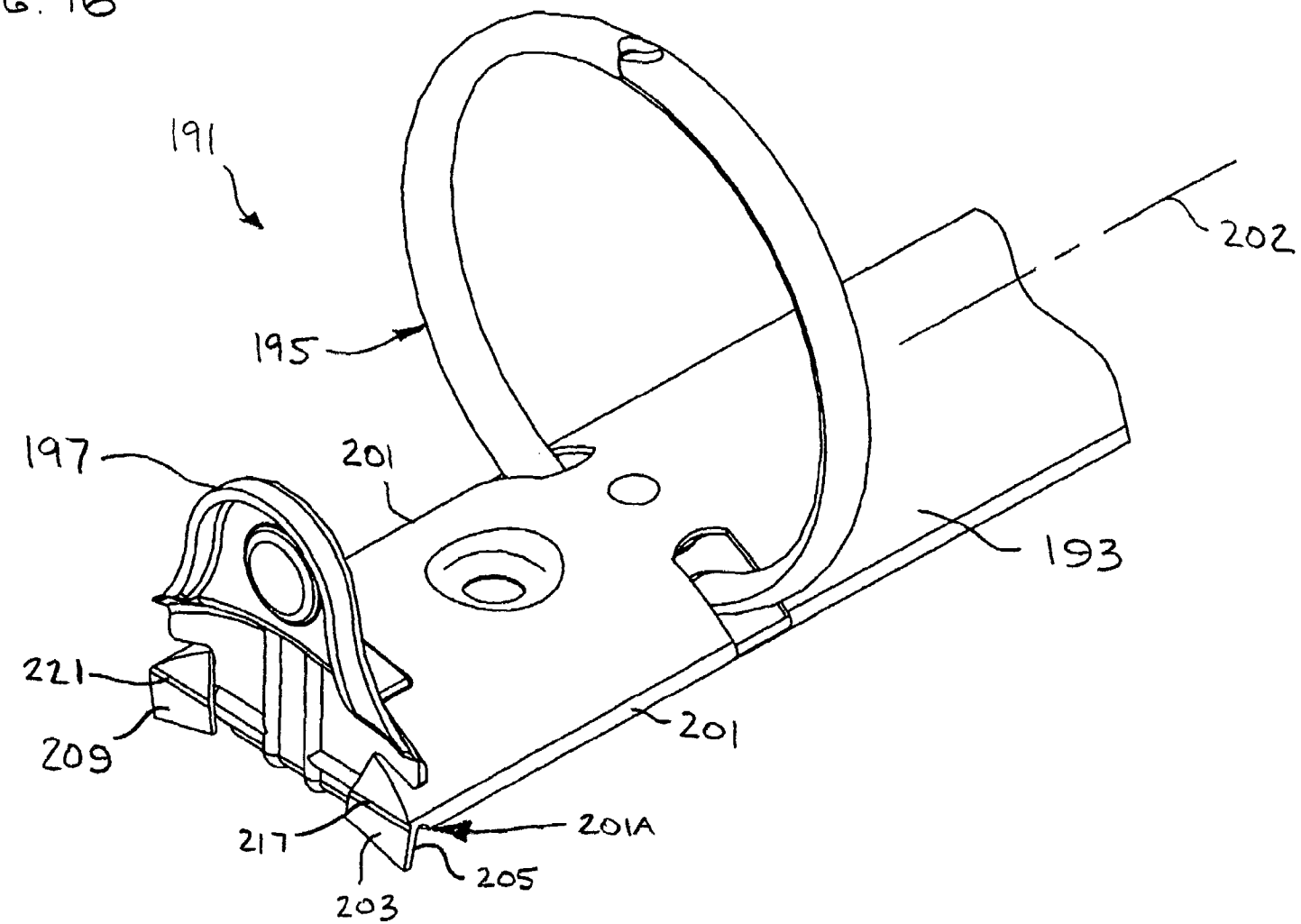
FIG. 16 is the perspective of FIG. 15 with all end portions in a bent condition.
Figure 17:
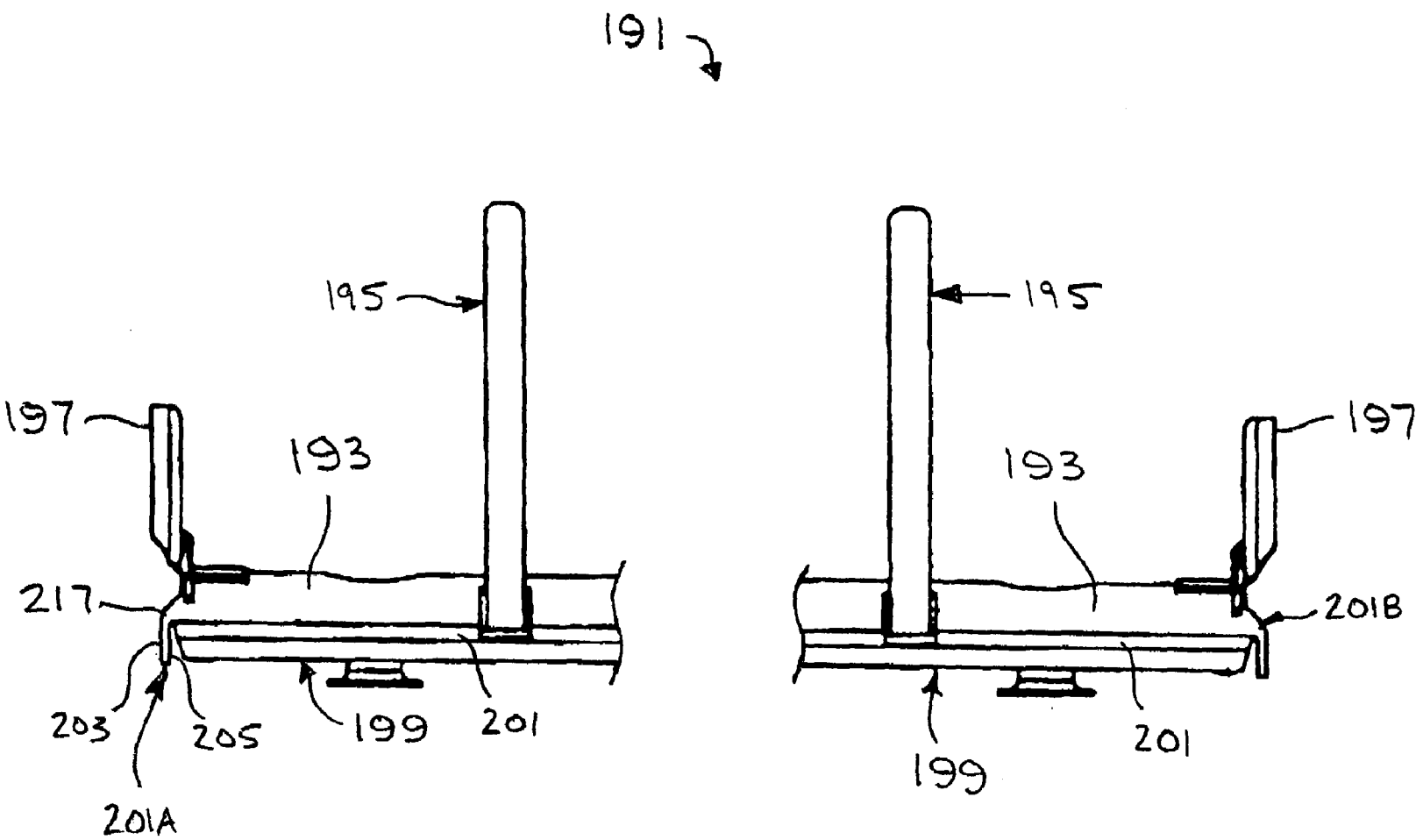
FIG. 17 is an enlarged, fragmentary side view of the mechanism of FIG. 14 with all end portions in a bent condition.

Referring specifically to FIG. 15, the end portions 203, 205,209,211 are depicted in an unbent condition, such as before the ring mechanism 191 is completely formed. The adjacent first and second end portions 203,205 are joined along the longitudinal edge 201 and are squeezed together into flatwise contact with one another before being bent over together about a common fold line 217 to an orientation generally perpendicular to the longitudinal axis 202 of the elongate plate 193 (FIGS. 16 and 17). Similarly, adjacent third and fourth end portions 209,211 are joined along the other longitudinal edge 201. The third and fourth end portions 209,211 are squeezed together into flatwise contact with one another before being bent over together about a common fold line 221 to an orientation generally perpendicular to the longitudinal axis 202 of the elongate plate 193. When squeezed together, the end portions 203,205,209,211 are slightly bent toward one another about individual fold lines before being bent over together about the respective common fold lines 217,221 to the orientation generally perpendicular to the longitudinal axis 202 of the elongate plate 193. An opposite longitudinal end 201B of the elongate plate 193 includes end portions as set forth immediately above. By pressing the adjacent end portions 203,205,209, 211 into flatwise contact with one another and bending them over to form blunt, longitudinally facing surfaces, the cut edges of the end portions are directed downward, thereby limiting their exposure and minimizing the likelihood of snagging clothing or scratching nearby items. Thus, the bent over end portions present a blunt, longitudinally facing surface. It is also contemplated that the end portions 203, 205,209,211 may be bent with two or more bends, rather than the single bend depicted in FIGS. 16 and 17.

The components of the mechanisms 21,61,141,191 of the foregoing embodiments are made of a suitable rigid material, such as a metal (e.g., steel). Mechanisms made of non-metallic materials, specifically including a plastic, do not depart from the scope of this invention.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A ring mechanism for a loose-leaf binder comprising:

a thin, elongate plate, at least two ring members supported by the elongate plate for relative movement of the ring members between an open position in which the ring members are spaced apart and loose-leaf pages may be received on and removed from at least one of the ring members, and a closed position in which the ring members are engaged to form a ring which is configured to capture the loose-leaf pages on the ring while permitting movement of the pages along the ring, the elongate plate having longitudinal ends, at least one of the longitudinal ends including first and second end portions located on one transverse side of the elongate plate, said first and second end portions being in flatwise contact with one another and bent over about a common fold line to present a longitudinally facing surface which is blunt.

2. A ring mechanism as set forth in claim 1 wherein each of said first and second end portions has a single bend.

3. A ring mechanism as set forth in claim 1 wherein the elongate plate further comprises third and fourth end portions on a transverse side of the elongate plate opposite the transverse side of the first and second end portions at said one longitudinal end, said third and fourth end portions being in flatwise contact with one another and bent over about a common fold line to present a longitudinally facing surface which is blunt.

4. A ring mechanism as set forth in claim 3 further comprising a lever pivotally mounted on the elongate plate generally at said at least one longitudinal end for actuating movement of the ring members between said open and closed positions.

5. A ring mechanism as set forth in claim 4 wherein the lever has one slot receiving one of the first and second end portions, and another slot receiving one of the third and fourth end portions at said at least one longitudinal end of the elongate plate.

6. A ring mechanism as set forth in claim 5 further comprising leaves operatively connected to the lever whereby the lever actuates pivoting movement of the leaves.

7. A ring mechanism as set forth in claim 3 wherein the first end portion is longer than the second end portion, and the third end portion is longer than the fourth end portion.

8. A ring mechanism as set forth in claim 7 wherein a distal end of the first end portion tapers from a first length at an inner lateral edge of the first end portion to a second length at an outer lateral edge of the first end portion, the first length being greater than the second length, and a distal end of the third end portion tapers from a first length at an inner lateral edge of the third end portion to a second length at an outer lateral edge of the third end portion, the first length of said third end portion being greater than said second length of said third end portion.

9. A ring mechanism as set forth in claim 8 wherein the distal end of each of the first, second, third and fourth end portions is generally perpendicular to the elongate plate.

10. A ring mechanism as set forth in claim 3 wherein the elongate plate further comprises fifth and sixth end portions at one transverse side of the elongate plate at another longitudinal end of the elongate plate, said fifth and sixth end portions being in flatwise contact with one another, seventh and eighth end portions on an opposite transverse side of the elongate plate at said other longitudinal end, said seventh and eighth end portions being in flatwise contact with one another, said fifth and sixth end portions at said other longitudinal end being bent over about a common fold line to present longitudinally facing surfaces which are blunt, and said seventh and eighth end portions at said other longitudinal end being bent over about a common fold line to present longitudinally facing surfaces which are blunt.

11. A ring mechanism as set forth in claim 10 further comprising a lever pivotally mounted on the elongate plate generally at said one longitudinal end for actuating movement of the ring members between said open and closed positions, and another lever pivotally mounted on the elongate plate at said other longitudinal end for actuating movement of the ring members between said open and closed positions.

12. A ring mechanism as set forth in claim 1 in combination with the loose-leaf binder, the ring mechanism being secured to the loose-leaf binder.

* * * * *